United States Patent [19]

Jeschke

[11] 4,227,459

[45] * Oct. 14, 1980

[54] TRANSFER DRUM FOR SHEET-FED ROTARY PRINTING PRESSES

[75] Inventor: Willi Jeschke, Heidelberg, Fed. Rep. of Germany

[73] Assignee: Heidelberger Druckmaschinen Aktiengesellschaft, Heidelberg, Fed. Rep. of Germany

[ * ] Notice: The portion of the term of this patent subsequent to Jan. 25, 1994, has been disclaimed.

[21] Appl. No.: 889,370

[22] Filed: Mar. 23, 1978

Related U.S. Application Data

[63] Continuation of Ser. No. 704,638, Jul. 12, 1976, abandoned.

[30] Foreign Application Priority Data

Jul. 11, 1975 [DE] Fed. Rep. of Germany ..... 2530951

[51] Int. Cl.[3] ..... B41F 21/04; B41F 27/12; B41F 29/04; B41F 7/22

[52] U.S. Cl. ..... 101/415.1; 101/246; 101/409

[58] Field of Search ..... 101/409, 410, 411, 412, 101/415.1, 246; 271/82, 277

[56] References Cited

U.S. PATENT DOCUMENTS

| | | | |
|---|---|---|---|
| 890,807 | 6/1908 | Smith, Jr. | 101/415.1 |
| 1,107,772 | 8/1914 | Fogwell | 101/415.1 |
| 1,436,688 | 11/1922 | Smith | 101/409 |
| 1,545,791 | 7/1925 | Owen | 101/415.1 |
| 2,305,852 | 12/1942 | Durham | 101/415.1 X |
| 2,767,653 | 10/1956 | Babicz | 101/415.1 X |
| 3,007,408 | 11/1961 | Taylor et al. | 101/415.1 X |
| 4,004,512 | 1/1977 | Jeschke | 101/410 |

*Primary Examiner*—J. Reed Fisher
*Attorney, Agent, or Firm*—Herbert L. Lerner

[57] ABSTRACT

Transfer drum for a sheet-fed rotary printing press includes a pair of spaced support discs mountable on a shaft of the printing press, a drum shell peripherally secured to the support discs and having an outer surface, a blanket reinforced with fabric plies and tautly covering the outer surface, the fabric plies being subjected to tensile force acting in a given direction, the blanket having two ends, and means for securing the ends of the blanket to the drum shell, the fabric plies being elastic in the given direction of action of the tensile force.

1 Claim, 4 Drawing Figures

TRANSFER DRUM FOR SHEET-FED ROTARY PRINTING PRESSES

This is a continuation of application Ser. No. 704,638, filed July 12, 1976, now abandoned.

The invention relates to a transfer drum for sheet-fed rotary printing presses having a drum shell mountable by support discs on a shaft, the drum shell having an outer surface tautly covered by a blanket reinforced with fabric plies or inlays, and means for holding both ends of the blanket.

A device of this general type is known from the German Pat. No. DT-PS 1,100,651 wherein mention is made of a blanket on a sheet-metal shell of a transfer drum, the surface of which is not supposed to take any ink so that set-off is prevented. To secure this blanket to the drum, tensioning spindles disposed in a cavity or depression formed in the drum body are provided.

In heretofore known devices of this type, it is necessary or an indispensable requirement generally known in printing technology that the so-called warp threads of the fabric plies or inlays of the blankets extend in direction of tensioning of the blankets. The weft threads of the fabric plies extending transversely to the warp threads generally impart a greater elasticity to the fabric in the direction of extension of the weft threads than do the warp threads, due to the type of weave. Since the tensioning devices of the blanket have only a limited tensioning travel or tensioning distance, it is absolutely necessary that the warp threads extend in tensioning direction when the blankets are sliced off during manufacture thereof. Assurance is thereby provided that the tensioning travel distances of the tensioning device are adequate.

The tensioning device for the blanket in the heretofore known transfer drums of this general type requires a great outlay for construction and takes up a considerable amount of space within the drum body. A result thereof is that a sheet held by a gripping device of the transfer drum has no support over a very great part of the length thereof. This can lead to discrepancies during sheet transfer and thereby to register errors and to mackling.

It is accordingly an object of the invention to provide a transfer drum for a sheet-fed rotary printing press which avoids the foregoing disadvantages of the heretofore known transfer drums of this general type and which, more specifically, affords the attainment of tensioning of the blanket on the drum shell at minimal technical expense and with optimal noninterrupted support of the sheet on the drum shell.

It is another object of the invention to provide such a transfer drum wherein the blanket may be exchanged in a minimal period of time and in a relatively simple manner.

With the foregoing and other objects in view, there is provided, in accordance with the invention, a transfer drum for a sheet-fed rotary printing press comprising a pair of spaced support discs mountable on a shaft of the printing press, a drum shell peripherally secured to the support discs and having an outer surface, a blanket reinforced with fabric plies and tautly covering the outer surface, the fabric plies being subjected to tensile force acting in a given direction, the blanket having two ends and means for securing the ends of the blanket to the drum shell, the fabric plies being elastic in the given direction of action of the tensile force. This is attained by disposing the blanket on the drum shell so that the direction in which the blanket stretches the least, extends parallel to the shaft or the axis of the drum shell. The direction in which the blanket stretches least is required for tensioning the blanket in peripheral direction of the drum in the case of current conventional tensioning devices for the blanket.

In accordance with another feature of the invention, the ends of the blanket tautly covering the drum shell have respective clamping edges extending in axial direction of the drum shell, and the fabric plies comprise warp threads disposed over the drum shell and extending substantially parallel to the clamping edges. Thus, readjustable tensioning rails or bars can be completely dispensed with, since the warp threads of the fabric plies or inlays of the blanket are not disposed in tensioning direction quite deliberately. On the contrary, the inherent elasticity of the blanket in direction of the weft threads is employed for tensioning the blanket.

In accordance with a further feature of the invention, the clamping edges of the blanket extending substantially parallel to the warp threads are formed as loops, and respective rod members are received in the loops with portions of the rod members exposed through recesses formed in the clamping edges, and bolt members are secured to the drum shell, the rod members being hooked on the bolt members at the exposed portions of the rod members. The blanket is thereby required to be hooked to the bolts only at the two ends thereof. A relatively simple lever tool can serve to produce the tensioning. Through the disposition of the loops at the edges of the blankes which extend substantially parallel to the warp threads, the greater elasticity acting in direction of the weft threads is utilized so that retensioning of the blanket during operation of the printing press is rendered superfluous or unnecessary.

In accordance with an additional feature of the invention, the bolt members on which the rod members are hooked are located at the inner surface of the drum shell. Due to this feature of the invention, no additional space is required on the outer surface of the drum shell.

In accordance with a concomitant feature of the invention, the support discs are formed with slots extending in peripheral direction thereof, and threaded fastening means are provided extending through the slots for adjustably clamping the support discs to the shaft of the printing press. The possibility is thereby afforded of swinging the drum shell a given distance away from the gripper device of the transfer drum in order to permit the rod carried in the loops at the edges of the blanket to be hooked on the bolts without hindrance or obstruction.

The invention of the instant application thus completely fulfills the requirements set out by the objects hereinaforementioned and permits an exchange of the blanket in a very brief period of time which advantageously manifests itself in a reduction in the shutdown time periods of the printing press.

Other features which are considered as characteristic for the invention are set forth in the appended claims.

Although the invention is illustrated and described herein as transfer drum for sheet-fed rotary printing presses, it is nevertheless not intended to be limited to the details shown, since various modifications may be made therein without departing from the spirit of the invention and within the scope and range of equivalents of the claims.

The invention, however, together with additional object and advantages thereof will be best understood from the following description when read in connection with the accompanying drawing in which.

Figure 1:
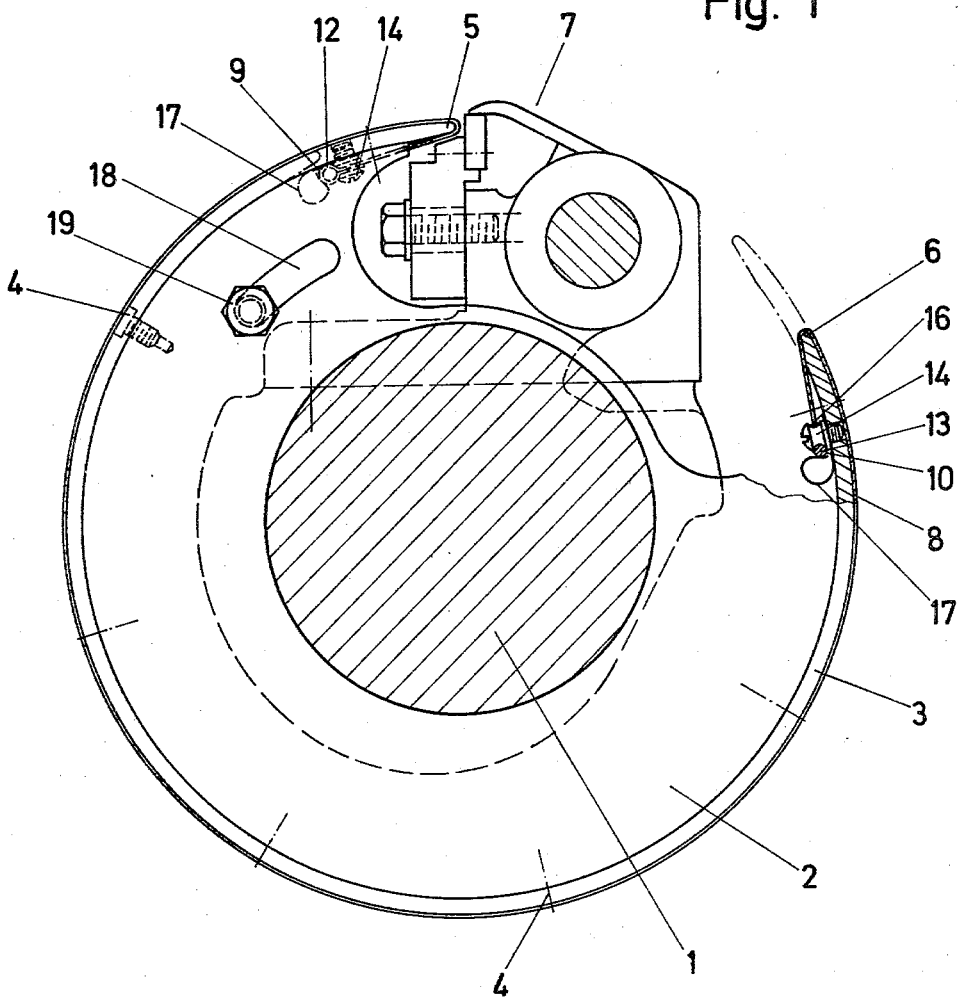
FIG. 1 is a side elevational view, partly in section, of a transfer drum having a clamping or tensioning device for a blanket stretched out thereon.

Referring now to the drawing, there is shown therein a pair of spaced support plates or discs 2 rotatably secured on a shaft 1 and carrying a drum casing or shell 3 of a transfer drum. The drum shell 3 is secured to the support discs 2 by fastening screws or bolts 4. A gripper device 7 for transporting sheets which is also fastened to the shaft 1 is disposed between both longitudinally extending edges 5 and 6 of the drum shell 3.

The outer surface of the drum shell 3 is tautly covered with a fabric blanket 8 stretched out thereon. The blanket 8 is formed with an ink-repelling surface, such as of microscopically small spherules or pellets, for example, which prevent deposition or settling of the ink.

Figure 2:
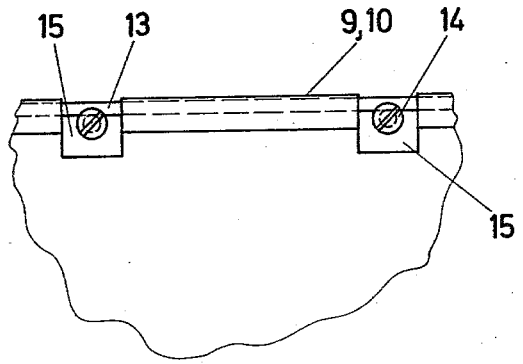
FIG. 2 is a fragmentary plan view of FIG. 1 as seen from the inside of the drum and rotated through an angle of 180°, and showing an edge of the blanket.
Figure 3:
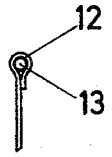
FIG. 3 is a fragmentary cross-sectional view of FIG. 2 showing the edge of the blanket as having a loop-shaped construction.

Both edges 9 and 10 of the stretched-out fabric blanket 8 extend parallel to the warp threads 11 of the blanket 8. The edges 9 and 10 are formed as loops (FIGS. 1 and 3), wherein respective rods 13 are inserted. The rods 13, in turn, hook into suitably configured bolts 14 that are fastened to the drum shell 3. The edges 9 and 10 of the blanket 8 are formed with recesses or cut-outs 15 (FIG. 2) in vicinity of the bolts 14 so that the rods 13 can hook into the bolts 14 without hindrance.

To facilitate the hooking of the rods 13 into the bolts 14, the latter are formed with grooves or channels 16. The bolts 14 are screwed into the underside or inside of the drum shell 3. In addition, clamping springs 17 are associated or coordinated therewith and prevent the rods 13 from being inadvertently unhooked from the bolts 14 when the blanket has not yet been subjected to suitable tensioning or adequately stretched out.

Figure 4:
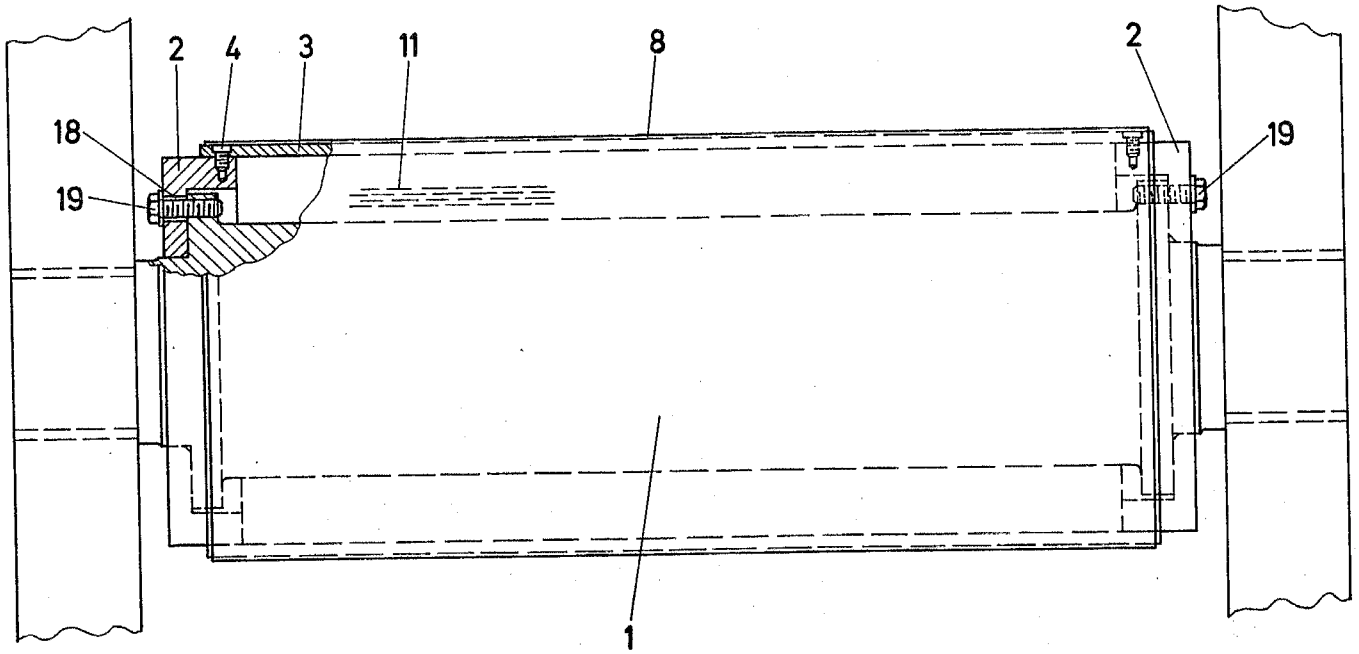
FIG. 4 is a reduced longitudinal view, partly in section, of FIG. 1.

In order to permit unhindered hooking of the edge of the blanket 8, the longitudinally extending edge 5 of the drum shell 3 is swingable away from the gripper device 7 to the position thereof shown in phantom in FIG. 1 by turning the drum shell 3 about the axis thereof and relative to the shaft 1. This swinging of the edge 5 away from the gripper device 7 is afforded by the provision of slots 18 formed in the support discs 2 so as to extend in peripheral direction thereof, as shown in FIG. 1, and clamping screws 19 disposed in the slots 18 and by means of which the support discs 2 are adjustably fastened to a flange portion (FIG. 4) of the shaft 1. After the stretched-out blanket 8 has been subjected to suitable tension, the drum shell 3 is again fastened to the shaft 1, in the view thereof shown in solid lines in FIG. 1. The blanket covering 8 thus starts directly behind the gripper device 7.

There is claimed:

1. Transfer drum for a sheet-fed rotary printing press comprising a pair of spaced support discs mountable on a shaft of the printing press, a drum shell peripherally secured to said support discs and having an outer surface, a blanket reinforced with fabric plies and tautly covering said outer surface, said fabric plies being subjected to tensile force acting in a given direction, said blanket having two ends, means for securing the ends of said blanket to said drum shell, said fabric plies being elastic in said given direction of action of said tension force, said support discs being formed with slots extending in peripheral direction thereof, and including threaded fastening means extending through said slots for adjustably clamping said support discs to the shaft of the printing press.

* * * * *